US007519495B2

(12) United States Patent
Schlemm

(10) Patent No.: US 7,519,495 B2
(45) Date of Patent: Apr. 14, 2009

(54) METHOD AND DEVICE FOR EXECUTING METHOD STEPS

(75) Inventor: Peter Schlemm, Wiesloch (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 410 days.

(21) Appl. No.: 09/927,545

(22) Filed: Aug. 9, 2001

(65) Prior Publication Data

US 2002/0022893 A1 Feb. 21, 2002

(30) Foreign Application Priority Data

Aug. 9, 2000 (DE) ..... 100 38 772

(51) Int. Cl.
*B41B 15/00* (2006.01)

(52) U.S. Cl. ..... 702/120; 358/1.13; 358/1.15; 358/1.16; 358/1.17; 358/400; 101/115

(58) Field of Classification Search ..... 702/120; 709/204; 101/129, 123, 126, 115; 358/1.13, 358/1.16, 1.15, 1.17, 1.18, 400, 406, 407, 358/442, 468

See application file for complete search history.

(56) References Cited

U.S. PATENT DOCUMENTS

| | | | | |
|---|---|---|---|---|
| 4,443,849 | A * | 4/1984 | Ohwada | 714/10 |
| 5,039,189 | A * | 8/1991 | Lytel et al. | 385/2 |
| 5,467,436 | A * | 11/1995 | Rodi et al. | 358/1.15 |
| 5,595,113 | A * | 1/1997 | Daniel et al. | 101/115 |
| 5,764,900 | A * | 6/1998 | Morris et al. | 709/203 |
| 5,983,191 | A * | 11/1999 | Ha et al. | 704/500 |
| 5,983,796 | A * | 11/1999 | Ishida et al. | 101/232 |
| 5,987,224 | A * | 11/1999 | Koakutsu et al. | 358/1.12 |
| 6,192,395 | B1 * | 2/2001 | Lerner et al. | 709/204 |
| 6,449,371 | B1 * | 9/2002 | Tan et al. | 381/119 |
| 6,771,378 | B2 * | 8/2004 | Akiyama et al. | 358/1.14 |
| 6,975,423 | B2 * | 12/2005 | Koakutsu et al. | 358/1.16 |
| 7,050,194 | B1 * | 5/2006 | Someno et al. | 358/1.9 |
| 2001/0024585 | A1 * | 9/2001 | Koakutsu et al. | 400/76 |
| 2003/0112457 | A1 * | 6/2003 | Akiyama et al. | 358/1.14 |

* cited by examiner

*Primary Examiner*—Carol S Tsai
(74) *Attorney, Agent, or Firm*—Laurence A. Greenberg; Werner H. Stemer; Ralph E. Locher

(57) ABSTRACT

A device and a method for executing method steps wherein an output signal is produced. Dependent on whether an output mode is switched on, the output signal is outputted. The output signal comprises items of information concerning the environment wherein the output signal was produced.

16 Claims, 2 Drawing Sheets

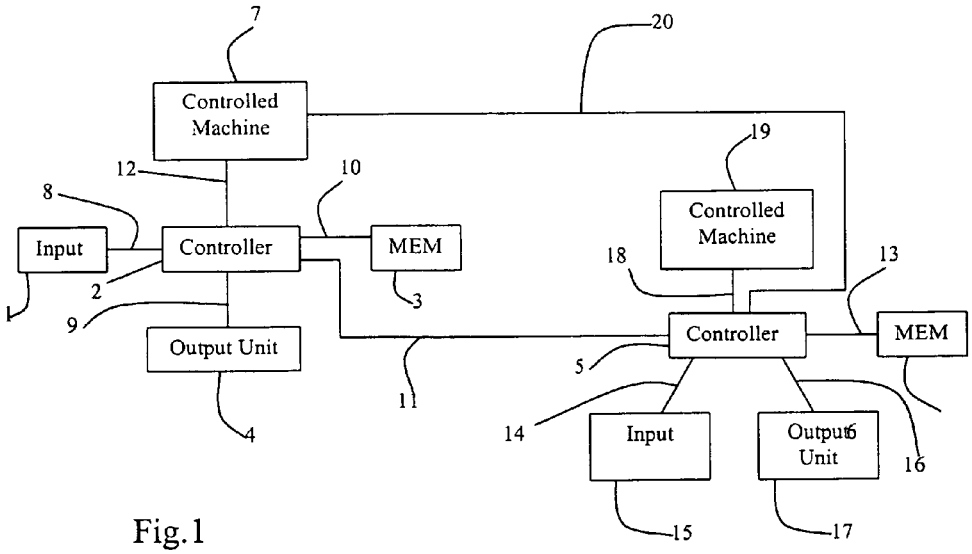
Fig.1
Fig.2
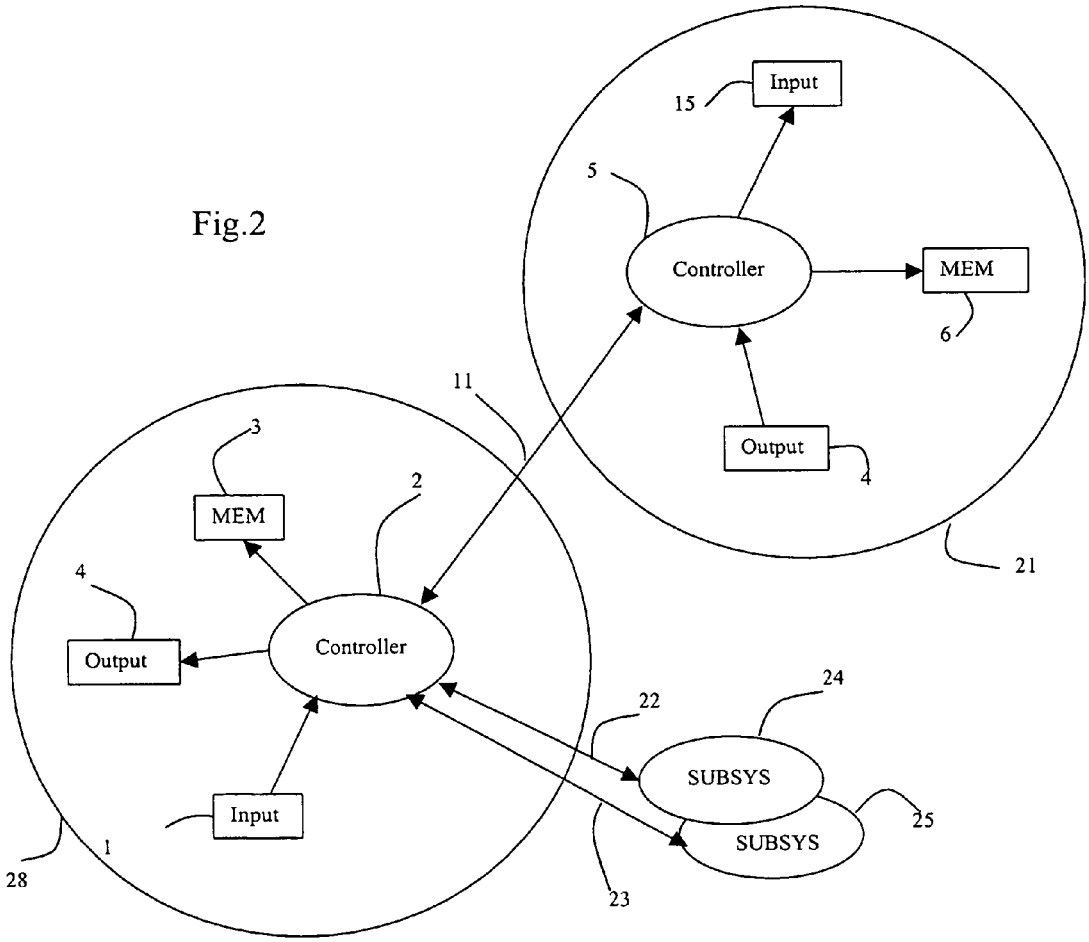

A1:Q,Q<X,Y>,SI<1>,MI<2>,Mo<2>,L<122>,<Info Mode>

A2:Q,Q<X,Y>,SI<0>,MI<1>,Mo<1>,L<48>,<Error Mode>

METHOD AND DEVICE FOR EXECUTING METHOD STEPS

BACKGROUND OF THE INVENTION

Field of the Invention

The invention relates to a method for processing method steps, whereby an output signal is output in one method step. The invention also pertains to the processing of method steps with a control device that outputs an output signal.

In the controlling of printing machines, for example, method steps are automatically executed in series by a control apparatus. The method steps comprise for example the controlling of a printing unit or the controlling of a print cylinder. Moreover, method steps are preferably provided with which a correct functioning of the controlled machine is monitored. If the control apparatus recognizes a malfunction, an output signal is produced and outputted via an output unit.

In addition, programs for producing a program flow are known wherein method steps are provided that monitor a correct execution of the program flow. If a program error is recognized in a method step, the error is output via an output unit.

SUMMARY OF THE INVENTION

The object of the present invention is to provide a method and device for executing method steps which overcome the above-noted deficiencies and disadvantages of the prior art devices and methods of this general kind, and which are provided for a greater degree of flexibility.

With the above and other objects in view there is provided, in accordance with the invention, a method of executing method steps, which comprises:

checking whether an output mode is switched on; and producing an output signal in a method step and outputting the output signal only if the output mode is switched on.

In other words, an output signal is outputted only if an output mode is switched on. The use of an output mode offers the advantage that output signals are output only when the output mode is switched on. If the output mode is not switched on, the output signal is produced but is not output.

In accordance with an added feature of the invention, the method steps are divided into modules, and the method comprises changing from one module to another module during the execution of the method steps, and wherein the output signal comprises an identifier indicating in which module the output signal was produced.

In accordance with an additional feature of the invention, the method steps are executed in a plurality of devices, and the output signal is generated with an identifier indicating the device in which the output signal was produced.

In accordance with another feature of the invention, the method steps are stored in a storage device, and the method comprises reading out the method steps from the storage device and executing the method steps, and wherein the output signal comprises an identifier indicating where the method step is stored that produced the output signal.

In accordance with a further feature of the invention, the output signal comprises an identifier indicating in which method step the output signal was produced.

In accordance with again an added feature of the invention, the output mode is one of a plurality of output modes, and the method comprises checking which output mode is set, and wherein the output signal comprises an identifier indicating to which output mode the output signal belongs, and wherein only the output signals belonging to the set output mode are outputted.

In accordance with again an additional feature of the invention, the output signal is output via an output unit as a signal selected from the group consisting of optical and acoustic signals.

In accordance with again another feature of the invention, the output signal is stored in a storage device, together with an indication of a time at which the output signal was stored.

With the above and other objects in view there is also provided, in accordance with the invention, a device for executing method steps, which comprises a control apparatus producing an output signal, the control apparatus being configured to check whether an output mode is switched on, and to output the output signal if the output mode is switched on.

In accordance with yet an added feature of the invention, the control apparatus is a first control apparatus and comprising a second control apparatus, and wherein one of the first and second control apparatus produces the output signal, and the first or second control apparatus outputs the output signal if an output mode is switched on, and the output signal comprises an identifier indicating whether the output signal was produced by the first or second control apparatus.

In accordance with yet an additional feature of the invention, the output signal includes an identifier indicating at which method step the output signal was produced.

In accordance with yet another feature of the invention, at least one of the first and second control apparatus executes method steps in the form of program modules, and the output signal comprises an identifier indicating the module in which the output signal was produced.

In accordance with yet a further feature of the invention, the method steps are stored in a storage device, and at least one of the first and second control apparatus is configured to read out the method steps for the execution from the storage device; and the output signal comprises an identifier indicating a location at which the method steps are stored in the storage device. The location is identified via a memory address and/or a data filename.

In accordance with a concomitant feature of the invention, input means are configured to enable selective switching on and switching off of the output mode even during the execution of the method steps.

Additional advantageous developments of the invention are indicated in the dependent claims. In preferred specific embodiments of the invention, the output signal comprises identifiers that for example indicate wherein module, wherein device, or wherein method step the output signal was produced. In further advantageous specific embodiments, the output signal comprises an identifier that indicates where the method step is stored that resulted in the production of the output signal.

In addition, various output modes are preferably provided wherein predetermined types of output signals are outputted, and the output signal preferably comprises an identifier that indicates which output mode is switched on.

In a further preferred specific embodiment, the output signal is stored in a storage device with an indication of the time at which the storing took place. This specific embodiment enables a statement concerning the time of occurrence of the output signal.

Other features which are considered as characteristic for the invention are set forth in the appended claims.

Although the invention is illustrated and described herein as embodied in a method and device for executing method steps, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 1 is a block diagram showing a device for executing method steps;

FIG. 2 is a schematic block diagram of a network of devices for executing method steps;

DESCRIPTION OF THE PREFERRED EMBODIMENTS

Figures 3, 4:
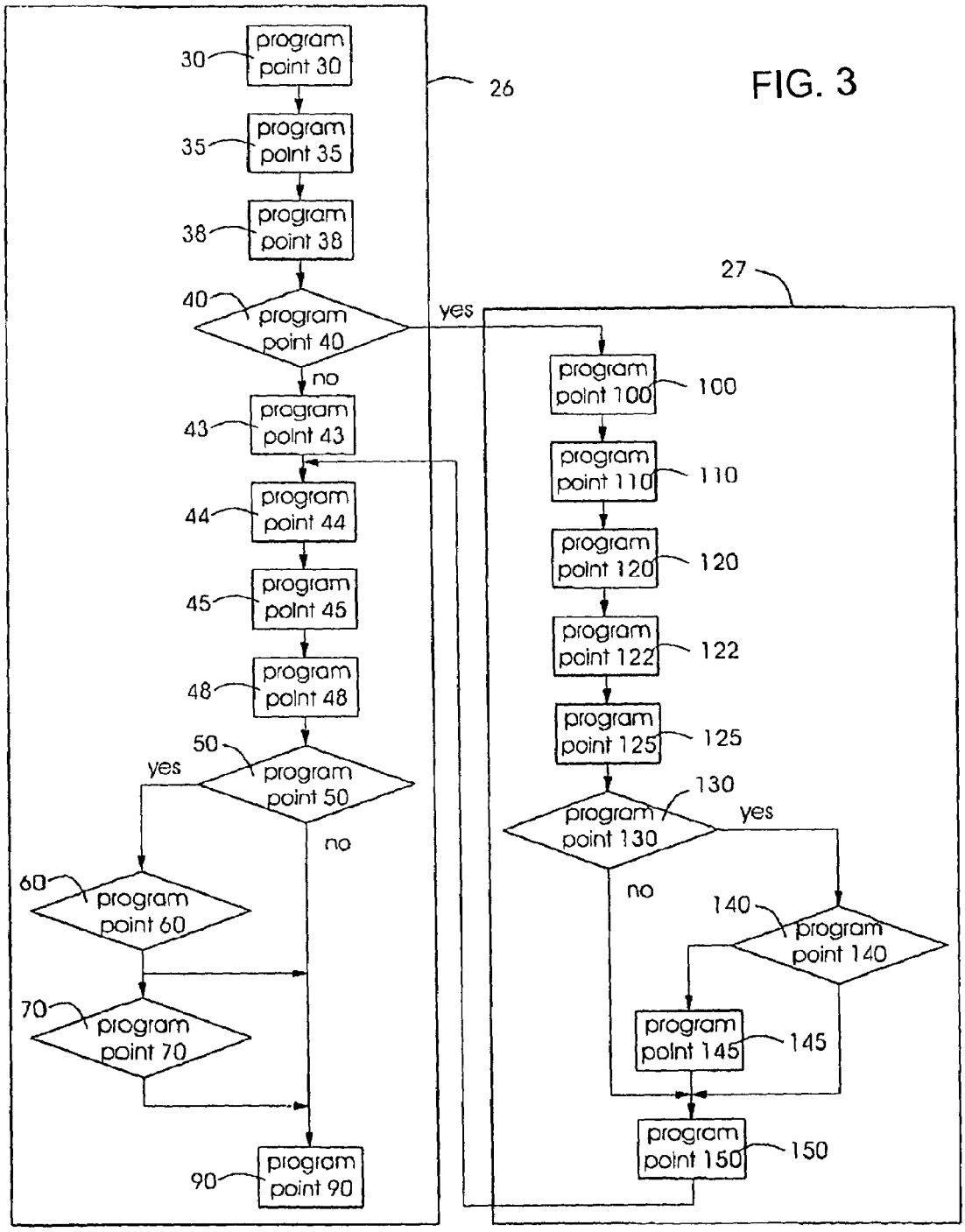
FIG. 3 is a flow diagram.
FIG. 4 shows two output signals.

Referring now to the figures of the drawing in detail and first, particularly, to FIG. 1 thereof, there is seen a device for controlling a first printing machine 7. Certain method steps are executed for controlling the first printing machine 7. The method steps are, by way of example, realized in the form of hardware and/or in the form of computer programs.

The device comprises a control apparatus 2, which is connected with an input unit 1 via an input line 8, and with an output unit 4 via an output line 9, and with a storage device 3 via a data line 10, and with a second control apparatus 5 via a first interface 11, and with first printing machine 7 via control lines 12. Instead of the first printing machine 7, the control apparatus 2 can be connected with a controlling element or an actuator. In other words, the invention is not limited to the controlling of a first printing machine 7, but rather is suitable for controlling of arbitrary types of controlling elements, controlled elements, and/or machines.

The second control apparatus 5 is connected with a second storage device 6 via a second data line 13. In addition, second control apparatus 5 is connected via a second input line 14 with a second input unit 15 and, via a second output line 16, with a second output unit 17. In addition, a second printing machine 19 is provided, with which the second control apparatus 5 is connected via second control lines 18. Instead of the second printing machine 19, a controlling element or another machine can be provided that is controlled by the second control apparatus 5. In a preferred specific embodiment, the second control apparatus 5 is connected with the first printing machine 7 via third control lines 20. In this specific embodiment, the first printing machine 7 is preferably controlled in various functions and/or simultaneously by the first and second control apparatus 2, 5.

The second control apparatus 5, with second input unit 15, second output unit 17, second storage device 6, and second printing machine 19, represents a subsystem that is monitored and/or controlled by the first control apparatus 2. The first control apparatus 2 thus represents a master computer that monitors and/or controls the second control apparatus 5, which is fashioned as a slave computer.

Referring now to FIG. 2, there is shown, schematically, a main system 28 with the first control apparatus 2 as a master computer, connected via an interface 11 with a first subsystem 21. The second control apparatus 5 is arranged in the first subsystem 21. In addition, main system 28 is connected, via additional interfaces 22, 23, with a second and third subsystem 24, 25. Second and third subsystem each comprise a control apparatus with input and output and storage device.

The design of a device for processing method steps in the form of a main system 28 and a plurality of subsystems 21, 24, 25 has the advantage that tasks are executed in parallel by subsystems, and the subsystems are monitored and controlled by the main system. In this way, a rapid execution of tasks is possible, since the tasks are executed in parallel. In addition, through the arrangement of the main system good coordination is enabled, for example with reference to the workload of the subsystems. In addition, the use of a plurality of subsystems has the advantage that one subsystem can be provided as a substitute system for another subsystem, whereby the substitute system takes over the tasks of the other subsystem when the latter has failed or is no longer functioning correctly.

At the same time, due to the subsystem structure it is difficult to have an overview concerning which subsystem executes method steps, and at which method step an output, in particular an errored output, is produced, and where the method step that produced an output command is stored.

In the following, the invention is explained in more detail on the basis of FIGS. 1 and 2, in relation to the program flow of FIG. 3. FIG. 3 shows a program flow divided into a first module 26 and a second module 27. The first module 26 comprises method steps 30 to 90, and the second module 27 comprises method steps 100 to 150. The first module 26 is executed in the first control apparatus 2 in the main system 28, and the second module 27 is executed in the first subsystem 21 by the second control apparatus 5. The method steps of the first module 26 are stored in the first storage device 3 (program memory), and the method steps of the second module 27 are stored in the second storage device 6 (program memory). Likewise, data and data files that are used for the execution of the first module 26 are preferably stored in the first storage device 3, and data and data files that are used for the execution of the second module 27 are preferably stored in the second data storage device 6.

At program point 30, the first control apparatus 2 starts the program flow and carries out an initialization of the data and data files required for the execution of first module 26. At the following program point 35, the first control apparatus 2 writes to the first storage device 3, in a first list, that the first module 26 is being executed, and additionally writes the memory address x, y from which the first module 26 was read out, and writes the first storage device 3 as the memory location of the memory address. In addition, the first storage device 2 writes to the first list that the first module 26 is being executed by the main system 28.

Subsequently, at program point 38 the first control apparatus 2 executes method steps. These can for example consist in the calculation of control data for a first printing machine 7, or in the preparation of an image to be printed out via a first printing machine 7. However, other tasks can also be executed by first control apparatus 2, wherein, for example, data are acquired by the input unit 1 or control data are outputted to the first printing machine 7.

Subsequently, at program point 40 a branching takes place to program point 100 of second module 27. The branching at program point 40 can be conditional or unconditional. The branching to program point 100 means that first control apparatus 2 outputs a control command to second control apparatus 5 via first interface 11. After receiving the control command at program point 100, second control apparatus 5 begins to execute second program module 27. At program point 100, second control apparatus 5 writes to a second list of second storage device 6 that the execution of second module 27 was initiated by first control apparatus 5 at program point 40 of first module 26.

Subsequently, at the following program point 110 second control apparatus 5 stores, in a third list of second storage device 6, the information that second module 27 is being executed, and that second module 27 is being executed by first subsystem 21, and that the data files wherein the method steps of second module 27 are stored are stored in second storage device 6 at memory address x, y.

Subsequently, at program point 120, second control apparatus 5 carries out predetermined method steps wherein, for example, an input is requested from second input unit 15, or a control parameter is calculated for controlling the second printing machine 19 and/or the first printing machine 7, or the second printing machine 19 and/or the first printing machine 7 are controlled with control parameters.

In addition, at program point 122 an output command is produced for the outputting of an item of information. An item of information is used for example to obtain an overview of the execution of the method steps. In a network, it is of interest to know which control apparatus executes, or makes use of, which method steps, modules, storage devices, etc. An item of output information is thereby preferably stored in a first output field of second data storage device 6, said information comprising for example one or more of the following: wherein module the output information was produced; that an item of output information is concerned; which system produced the output information; which output mode is concerned; at which program step the output information was produced; wherein data file the program step is stored, and at which memory address, and wherein storage device the data file is stored.

Subsequently, program step 125 is executed, wherein a correct functioning of the execution of the program steps of second module 27, or a correct functioning of first and second printing machine 7, 19 is monitored. If the monitoring of the execution of the method steps reveals that an error has occurred, an item of error information is stored in a second output field of second storage device 6. The item of error information includes at least one of the following: wherein module the output information was produced; which system produced the output information; which output mode is concerned; at which program step the output information was produced; wherein data file the program step is stored, and at which memory address, and wherein storage device the data file is stored; that an item of error information is concerned relating to the program flow of second module 27.

If the monitoring of the functioning of first or second printing machine 7, 19 reveals that a malfunction has occurred, then in second storage device 6 an item of output information is stored in a third output field, said information preferably including at least one of the following: wherein module the output information was produced; which system produced the output information; which output mode is concerned; at which program step the output information was produced; wherein data file the program step is stored, and at which memory address, and wherein storage device the data file is stored; the fact that an error output is concerned relating to the first and/or the second printing machine 7, 19, according to the printing machine 7, 19 at which the error was recognized.

In the following program step 130, second control apparatus 5 checks whether the first, second, or third output field of second storage device 6 is occupied. If this is the case, branching takes place to program point 140. At program point 140 it is checked whether the information mode, the error mode for the program flow, or the error mode for the manner of functioning of first or second printing machine 7, 19 is switched on. In addition, for the three output modes there are stored in second storage device 6 three memory fields, which are occupied with the value 1 when the corresponding modes are switched on. A switching on of the modes takes place either via an input or, dependent on a condition, automatically via second control apparatus 5.

If the query at program point 140 yields the result that one of the three output mode is switched on, branching takes place to program point 145. At program point 145, the output information is outputted via first or second output unit 4, 17. Subsequently, branching takes place to program point 150.

If the query at program point 140 yields the result that none of the output modes are switched on, branching takes place directly to program point 150.

If the query at program point 130 yields the result that none of the output fields are occupied, branching takes place directly to program point 150.

At program point 150, additional method steps of second module 27 are executed, and a control command is subsequently handed over to first control apparatus 2 via first interface 11. According to the specific embodiment of second module 27, data and/or calculated values are also handed over to first control apparatus 2.

After receiving the control command, control apparatus 2 further executes first module 26 at program point 40. Additional method steps are thereby executed corresponding to program point 38.

Program point 30 contains method steps that are executed by control apparatus 2 if at program point 40 branching does not take place to program point 100. Program point 44 follows after execution of program point 30.

After execution of the method steps, at program point 45 an information output is produced, preferably dependent on a predetermined event, and is stored by first control apparatus 2 in first storage device 3, in a first output field. The information output preferably comprises at least one of the following items of information: the information was produced in first module 26; the information output was produced at method step 45; the method step was executed by the main system; an information output is concerned; wherein data file the method step is stored that resulted in the information output, and at which memory address of first storage device 3 the data file is stored.

Subsequently, program point 48 is executed, wherein a correct functioning of the execution of the program steps of first module 26, or a correct functioning of first and second printing machine 7, 19, is monitored. If the monitoring of the execution of the method steps reveals that an error has occurred, an item of error information is stored in a second output field of first storage device 3. The item of error information includes at least one of the following: wherein module the output information was produced; which system produced the output information; which output mode is concerned; at which program step the output information was produced; wherein data file the program step is stored, and at which memory address, and wherein storage device the data file is stored; the fact that an item of error information is concerned relating to the program flow.

If the monitoring of the functioning of first or second printing machine 7, 19 reveals that a malfunction has occurred, then in third storage device 3 an item of output information is stored in a third output field. The item of information preferably includes at least one of the following: wherein module the output information was produced; which system produced the output information; which output mode is concerned; at which program step the output information was produced; wherein data file the program step is stored, and at which memory address, and wherein storage device the data file is stored; the fact that an error output is concerned relating to first and/or second printing machine 7, 19, according to the printing machine 7, 19 at which the error was recognized.

At the following program point 50, the first control apparatus 2 checks whether one of the three output fields in the first storage device 3 is occupied. If the query returns a negative, branching takes place to program point 90.

If the check at program point 50 reveals that at least one of the three output fields is occupied, branching takes place to program point 60. At program point 60, first control apparatus 2 checks whether the output mode for an item of information, the output mode for an error message relating to the program flow, or the output mode for the error message relating to the functioning of first or second printing machine 7, 19 is switched on. For this purpose, in storage device 3 there are stored three memory fields, one memory field being allocated respectively to one of the three modes of information. If an output mode is switched on, the corresponding memory field is occupied with the value 1.

If the query at program point 60 reveals that at least one of the three output modes is switched on, branching takes place to program point 70. If the query at program point 60 reveals that none of the three output modes is switched on, branching takes place directly to program point 90.

At program point 70, first control apparatus 2 outputs the information concerning first or second output unit 4, 17.

Subsequently, branching takes place to program point 90, at which for example first module 26 is terminated.

FIG. 4 shows a first item of output information A1 for an information output, whereby SI<1> indicates an identifier for first subsystem 21, MI<2> indicates an identifier for second module 27, MO<2> indicates an identifier for output mode Information, L<122> indicates an identifier for the method step 122 at which the output information was produced, and Info-Mode indicates a brief item of information. Preferably, the name of the data file Q and the memory location Q<x,y> of the data file wherein method step 122 is stored are also output.

The second output information A2 is an example of an error output, and has identifier SI<0> for main system 28, identifier MI <1> for first module 26, identifier MO <1> for the output mode 'error message,' identifier L<48> for indicating the method step at which the error information was produced, the word 'error mode' for the indication that an item of error information is concerned, and identifier Q as the name of the data file wherein method step 48 is stored, and Q<x,y> as the memory address at which the data file is stored in first storage device 3.

According to the specific embodiment, the outputs can contain a combination of the identifiers shown in FIG. 4.

In a preferred specific embodiment, the output modes can be switched on or switched off during the operation of first and second control apparatus 2, 5. In addition, the content of the outputs can be modified via a corresponding input via first or second input unit 1, 15. For example, different items of information can be determined for output for the various output modes.

In addition, via a corresponding input it can also be determined that items of information are not outputted, but rather are written into an output data file of first or second storage device 3, 6. The date and time of the storing are thereby preferably also stored during the storing of the output data file. In this way, the output information can be called at a later time, and, in addition, the time of the occurrence of the output information can be requested.

An advantage of the invention is that the type of outputting of an item of output information can be set in a flexible fashion, and, in addition, the output information includes an indication concerning at which method step, at which module, and at which main system or subsystem the output information was produced. In this way, despite a distributed execution of method steps, an overview is provided of the environment wherein the output information was produced.

I claim:

1. A method of executing method steps with an apparatus controlling a printing press, the method which comprises:

connecting the apparatus to an input unit;

enabling the apparatus for switching an error mode on or off via the input unit;

checking whether the error mode is switched on via the input unit; and producing an output signal in a method step, only outputting the output signal as at least one of an optical or an acoustic signal if the error mode is switched on and not outputting the output signal if the error mode is not switched on.

2. The method according to claim 1, wherein the method steps are divided into modules, and the method comprises changing from one module to another module during the execution of the method steps, and wherein the output signal comprises an identifier indicating in which module the output signal was produced.

3. The method according to claim 1, which comprises executing the method steps in a plurality of devices, and generating the output signal with an identifier indicating the device in which the output signal was produced.

4. The method according to claim 1, wherein the method steps are stored as digital data in a storage device, and the method comprises reading out the method steps from the storage device and executed the method steps, and wherein the output signal comprises an identifier indicating where the method step is stored that produced the output signal.

5. The method according to claim 1, wherein the output signal comprises an identifier indicating in which method step the output signal was produced.

6. The method according to claim 1, wherein the error mode is one of a plurality of error modes, and the method comprises checking which error mode is set, and wherein the output signal comprises an identifier indicating to which error mode the output signal belongs, and wherein only the output signals belonging to the set error mode are outputted.

7. The method according to claim 1, which comprises outputting the output signal via an output unit.

8. The method according to claim 1, wherein the output signal is stored in a storage device, together with an indication of a time at which the output signal was stored.

9. A device for executing method steps, which comprises a control apparatus for controlling a printing press, said control apparatus producing an output signal, said control apparatus being connected to an input unit and configured for enabling an error mode to be switched on or off via said input unit, to check whether an error mode is switched on via said input unit, and to output the output signal as at least one of an optical or an acoustic signal only if the error mode is switched on via said input unit and not to output the output signal if the error mode is not switched on via said input unit.

10. The device according to claim 9, wherein said control apparatus is a first control apparatus and comprising a second control apparatus, and wherein one of said first and second control apparatus produces the output signal, and said first or second control apparatus outputs the output signal if an error mode is switched on, and the output signal comprises an identifier indicating whether the output signal was produced by said first or second control apparatus.

11. The device according to claim 9, wherein the output signal includes an identifier indicating at which method step the output signal was produced.

12. The device according to claim 10, wherein at least one of said first and second control apparatus executes method steps in the form of program modules, and the output signal comprises an identifier indicating the module in which the output signal was produced.

13. The device according to claim 10, which further comprises a storage device storing the method steps;

and wherein at least one of said first and second control apparatus is configured to read out the method steps for the execution from the storage device; and wherein the output signal comprises an identifier indicating a location at which the method steps are stored as digital data in said storage device.

14. The device according to claim 13, wherein the location is identified in said storage device via a memory address.

15. The device according to claim 13, wherein the location is identified in said storage device via a data filename.

16. The device according to claim 9, which further comprises input means configured to enable selective switching on and switching off of the error mode even during the execution of the method steps.

* * * * *